US006019812A

United States Patent [19]

Volas et al.

[11] Patent Number: 6,019,812

[45] Date of Patent: Feb. 1, 2000

[54] SUBATMOSPHERIC PLASMA COLD HEARTH MELTING PROCESS

[75] Inventors: Michael G. Volas; William R. Chinnis, both of Charlotte, N.C.

[73] Assignee: Teledyne Industries, Inc., Pittsburgh, Pa.

[21] Appl. No.: 08/954,860

[22] Filed: Oct. 21, 1997

Related U.S. Application Data

[60] Provisional application No. 60/029,575, Oct. 22, 1996.

[51] Int. Cl.[7] ..... C21B 11/10

[52] U.S. Cl. ..... 75/10.19; 75/10.64; 75/612; 164/494

[58] Field of Search ..... 75/10.19, 10.2, 75/10.21, 10.64, 621, 112; 164/514, 495

[56] References Cited

U.S. PATENT DOCUMENTS

| | | | |
|---|---|---|---|
| Re. 32,932 | 5/1989 | Harker et al. . | |
| 3,894,573 | 7/1975 | Paton et al. | 164/469 |
| 4,861,001 | 8/1989 | Schlienger . | |
| 5,201,457 | 1/1993 | Kitayama et al. | 148/671 |
| 5,311,655 | 5/1994 | Jager et al. | 164/495 |

OTHER PUBLICATIONS

W.H. Buttrill et al., "Hearth Melt Plus Vacuum Arc Remelt: Production Status", *Titanium '95: Science and Technology,* from a collection of papers published following the Titanium 95 Conference in Birmingham England, Oct. 22–26, 1995, pp. 1446–1453.

Clifford E. Shamblen, "Titanium Alloy Hearth Melt "Only" Technology Development", *Titanium '95; Science and Technology,* from a collection of papers published following the Titanium 95 Conference in Birmingham England, Oct. 22–26, 1995, pp. 1338–1445.

W.R. Chinnis, "Advances in Titanium Plasma Cold Hearth Melting", *Titanium '95: Science and Technology,* from a collection of papers published following the Titanium 95 Conference in Birmingham England, Oct. 22–26, 1995, pp. 1494–1499.

*Primary Examiner*—Prince Willis
*Assistant Examiner*—Tima McGuthry-Banks
*Attorney, Agent, or Firm*—Alston & Bird LLP

[57] ABSTRACT

A plasma cold hearth melting process which provides an ingot of improved properties and including a plasma cold hearth melting furnace operated inside an air-tight chamber containing an inert gas, such as helium, at subatmospheric pressure levels. Raw material metals for a desired titanium or titanium alloy composition are supplied to a melting hearth located inside the chamber and heated by a plasma torch which utilizes an inert gas. The plasma torch melts the raw material metal thereby forming a molten pool of metal that is directed to at least one refining hearth. Plasma torches located in the refining hearths maintain the composition in a molten state as it passes through the cold hearth furnace to allow impurities present in the composition to be refined therefrom. After passing through the refining hearths, the molten pool of metal is poured into an ingot mold while still under subatmospheric inert gas pressure. The molten material is then allowed to cool and solidify into an ingot. The thus formed ingot is then subjected to hot working and fabrication operations without any intervening melting or refining steps.

8 Claims, 1 Drawing Sheet

SUBATMOSPHERIC PLASMA COLD HEARTH MELTING PROCESS

CROSS-REFERENCE TO RELATED APPLICATIONS

This is related to copending Provisional Application Number 60/029,575 filed on Oct. 22, 1996 and claims priority therefrom under 35 U.S.C. §119(e).

FEDERALLY SPONSORED RESEARCH OR DEVELOPMENT

The invention was made in conjunction with the United States Air Force ManTech program pursuant to contract number F33615-88-C-5418.

FIELD OF THE INVENTION

This invention relates to the melting of titanium in a plasma cold hearth furnace. More particularly, this invention relates to a plasma cold hearth melting process which provides a titanium ingot of improved properties.

BACKGROUND OF THE INVENTION

Many modern aircraft engines use substantial amounts of titanium (Ti) alloys in the fan and compressor sections. Since such sections of an aircraft engine are critical to the performance of the engine, the quality of the titanium alloys employed is a major concern. Jet engine failures have been directly attributed to the undetected presence of defects in the titanium components.

These defects include high density inclusions and hard alpha inclusions. High density inclusions (HDIs) are particles of significantly higher density than titanium and are introduced through contamination of raw materials used for ingot production. These defects are commonly molybdenum, tantalum, tungsten, and tungsten carbide. Hard alpha defects are titanium particles or regions with high concentrations of the interstitial alpha stabilizers, such as nitrogen, oxygen, or carbon. The worst defects are usually high in nitrogen and generally result from titanium burning in the presence of air during raw material production. Both types of defects discussed above are difficult to detect using conventional post-production inspection techniques.

The current industry accepted processes for producing premium high quality alloys, such as titanium alloys, are triple vacuum arc remelting (VAR) and a process involving an initial melting step in a cold hearth furnace followed by vacuum arc remelting (HM+VAR). The VAR process, even with the inclusion of premelt procedural requirements and post-production nondestructive test (NDT) inspections has proven unable to completely exclude hard alpha inclusions and has shown only a minimal capability for eliminating HDIs. The addition of cold hearth melting as an initial refining step in an alloy refining process has been extremely successful in eliminating the occurrence of HDI inclusions without the additional raw material inspection steps necessary in a triple VAR process. The HM process has also shown promise in eliminating hard alpha inclusions. However, the plasma cold hearth melting step is typically followed by a final VAR process. The VAR process gives known results but risks reintroducing inclusions or impurities into the ingot. To eliminate the final VAR step would allow the full realization of the benefits of the plasma cold hearth melting and would also provide significant economic advantages. A hearth melt only process could be carried out more economically than a triple VAR process or a process involving hearth melting followed by VAR. Additionally, a hearth melt only process gives improved elimination of melt-related defects.

The superiority of the HM process is derived from the fact that the molten metal must continuously travel through a horizonal water cooled hearth before passing into the ingot mold. Separation of the melting and casting zones produces a more controlled molten metal residence time which leads to better elimination of inclusions by mechanisms such as dissolution and density separation. Accordingly, there is a need in the art for a refining process involving a plasma cold hearth melting step only without the inclusion of a final VAR process. Problems associated with current industry processes, as well as aspects of the present invention are more fully explained in the paper by Clifford E. Shamblen (the Shamblen paper) entitled "Titanium Alloy Hearth Melt Only Technology Development" which appeared in the collection of papers entitled *Titanium* '95: *Science and Technology*. This paper is incorporated herein by reference.

SUMMARY OF THE INVENTION

The alloy refining process of the present invention uses a plasma cold hearth melting process without the addition of a VAR step to provide an improved ingot with fewer defects and inclusions located therein. The present invention provides an improved plasma cold hearth melting process with improved defect elimination by operating under subatmospheric conditions when producing an ingot of titanium or a titanium alloy. Using a subatmospheric pressure in the hearth melt chamber enhances the ability of the process to reduce hydrogen content, reduces the possibility of entrapping inert gas in the ingot, and reduces the number of surface defects.

The alloy refining method of the present invention involves a plasma cold hearth melting furnace inside an airtight chamber. The chamber contains an inert gas, such as helium, at subatmospheric pressure levels. Raw material metals for a desired titanium composition are supplied to the melting hearth located inside the chamber. A plasma torch which utilizes an inert gas, such as a transferred arc plasma torch, is located above the melting hearth and melts the raw material metal thereby forming a molten pool of metal. The molten pool of metal is directed from the melting hearth to at least one refining hearth. Above each refining hearth, another plasma torch is located. The plasma torches in the refining hearths maintain the titanium composition in a molten state as it passes through the cold hearth furnace to allow impurities present in the composition to be refined therefrom. After passing through the refining hearths, the molten pool of metal is poured into an ingot mold while still under subatmospheric inert gas pressure. The surface of the molten material in the ingot mold is also heated by a plasma torch to control the cooling and solidification of the material in the ingot in a desired manner. Once cast into the ingot mold, the thus refined titanium composition cools and solidifies thereby forming into a titanium ingot which is gradually moved downward within the mold and removed. The thus formed ingot is then subjected to hot working and fabrication operations without any intervening melting or refining steps. The inert gas pressure inside the cold hearth furnace is preferably maintained below 500 torr. More preferably, the inert gas pressure is maintained at between 280 and 400 torr.

BRIEF DESCRIPTION OF THE DRAWING

Figure 1:
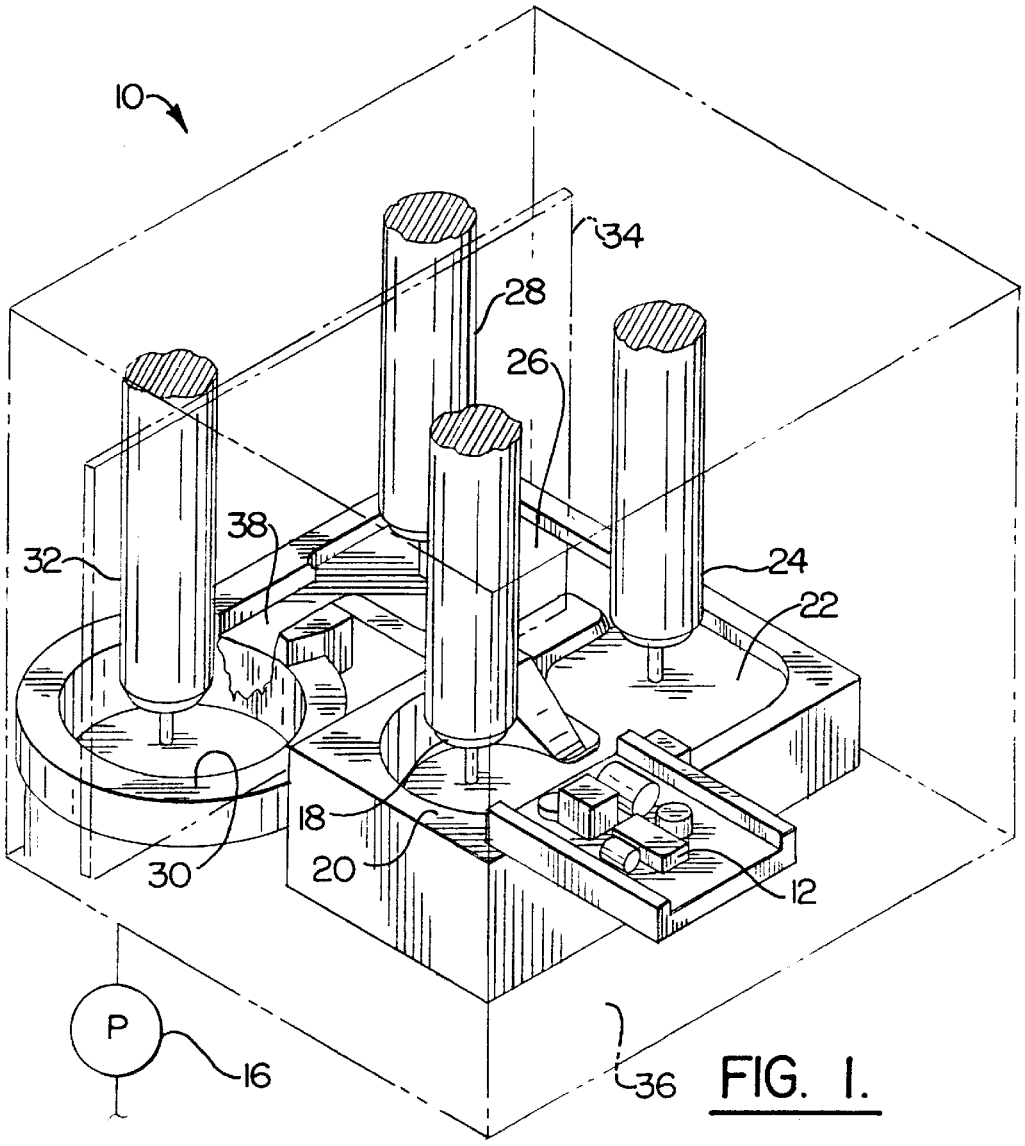

Having thus described the invention in general terms, reference will now be made to the accompanying drawing, which is not necessarily drawn to scale, and which is a perspective view of a plasma cold hearth furnace.

DETAILED DESCRIPTION OF THE INVENTION

The present invention now will be described more fully hereinafter with reference to the accompanying drawing, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The plasma cold hearth furnace 10 of the present invention is illustrated in FIG. 1. Pieces of raw material metal 12 are fed into a first hearth, referred to as the melting hearth 20. In the melting hearth 20, the raw material metal 12 is melted into a molten pool by means of a plasma torch 18. The molten pool of metal then flows over a shallow lip (not shown) into a first refining hearth 22. The molten pool of metal is further heated in the refining hearth 22 by another plasma torch 24. The molten pool of metal then passes over another shallow lip (not shown) into a second refining hearth 26. In the second refining hearth 26, the molten pool is further heated by another plasma torch 28. The second refining hearth 26 is positioned such that the direction of flow between the first refining hearth 22 and the second refining hearth forms a right angle with the direction of flow from the melting hearth 20 to the first refining hearth as illustrated in FIG. 1. From the second refining hearth 26 the molten pool of metal passes over another shallow lip 38 into an ingot mold 30. The ingot mold 30 is positioned such that the direction of flow between the second refining hearth 26 and the ingot mold forms a right angle with the direction of flow from the first refining hearth 22 to the second refining hearth as illustrated by FIG. 1. The top surface of the molten metal within the ingot mold is heated by a plasma torch 32. As the molten metal in the ingot mold 30 cools and solidifies, it forms a metal ingot which is withdrawn from the bottom of the ingot mold. Advantageously, a separation panel 34 is placed between the melting hearth 20 and the ingot mold 30 to prevent spattering of unrefined molten metal into the ingot mold. Ingots from about 14 inches in diameter to about 30 inches in diameter can be cast in lengths up to about 250 inches by the plasma cold hearth furnace 10 of the present invention.

The raw material metals 12 may be fed onto the melting hearth 20 by a suitable bulk feeder (not shown). In one embodiment, the melting hearth 20 and the ingot mold 30 are equipped with isolation valves so that multiple ingots can be cast and removed without opening the furnace 10.

The entire furnace apparatus is contained within a chamber 36. The chamber 36 is an air tight compartment containing an inert gas atmosphere. Argon, helium or a mixture thereof can be used. Preferably, a 100% helium atmosphere is used which gives the highest energy efficiency. Although conventional cold hearth melting processing operate at a slightly positive inert gas pressure of about 820 to 880 torr, the process of the present invention operates at subatmospheric pressure levels. Preferably, the inert gas pressure inside the furnace chamber is less than 500 torr. Most preferably, the inert gas pressure is between 280 and 400 torr. The pump 16 is used to evacuate the chamber 36 in order to lower the inert gas pressure. By using subatmospheric pressure, the amount of hydrogen trapped in the ingots is reduced. Additionally, the possibility of inert gas, such as helium, being trapped as voids or bubbles in the ingot is substantially reduced. Also, another important advantage of subatmospheric melting is the fact that the torches operate more efficiently resulting in higher melt rates and/or hotter pools. Also, the subatmospheric melting process of this invention improves the surface properties of the resulting ingot which allows a reduction in the amount of grinding needed to remove surface defects. This achieves an increase in process yield. The improved ingot surface properties achieved in accordance with the subatmospheric cold hearth melting process of the present invention as compared to conventional melting are illustrated by the photographs in FIG. 4 of the Shamblen paper. As noted in the Shamblen paper, ingot to billet process yield was increased from about 72% to 80% by using the subatmospheric process of the present invention.

The plasma torches may, for example, be 750 kilowatt transferred arc plasma torches manufactured by Retech, Inc. Each of the plasma torches uses up to 110 standard cubic feet per minute of helium. Advantageously, a gas recycling system is utilized with the furnace to provide particulate separation, compression, and removal of hydrocarbons, hydrogen and moisture. Preferably, oxygen and moisture concentrations are maintained at less than 10 ppm.

All of the hearths and the ingot mold are preferably constructed of copper. Coolant is circulated through pipes located in the hearth blocks and in the ingot mold block. The coolant serves to cool the outer layer of molten metal into a solid skull that provides a barrier between the copper hearth and the liquid pool of metal. Preferably, the coolant is water.

As the molten metal flows through each of the hearths and is exposed to the heating of the plasma torch, any HDI material fed in with the raw materials will sink to the bottom of the pool and become trapped in the skull. If the raw material metals contained a hard alpha defect with a higher density than the molten pool of metal, it will also be removed in a similar manner. If the hard alpha defect is less dense than the molten pool, it will be carried along with the flow and must be dissolved before reaching the ingot mold. As a result, pool super heat, pool volume, melt rate, and residence times are important factors because they effect the dissolution rate.

Pool temperature plays an important role in both density separation and diffusion of inclusion defects in the molten metal. In the preferred embodiment, a pyrometer is used to measure the pool temperature and surface area inside the plasma cold hearth furnace. This instrument uses a modified CCD television camera with a near I.R. (780 nm) band pass filter. The camera gives a 640×480 point spatial resolution with a 2° C. thermal resolution. The output from the camera is digitized and a temperature map of the hearth pool surface is calculated. Preferably, pool temperature and pool surface area statistics are gathered using the camera and used in furnace control as measurements of process stability.

The mass flow rate through the hearth and the molten pool volume control the residence time, which is important to both the dissolution and sinking defect removal mechanisms. One way to measure the mass flow rate is as an ingot casting rate. In the preferred embodiment of the present invention, a television camera images the pool in the near I.R. from a low angle to the horizontal. The interface between the hot pool and the cold mold is detected and can be used to measure the ingot casting rate.

The use of pure helium in the process introduces contaminants in the ppm concentration range. Analysis of these contaminants reveals much about the state of the process. Advantageously, the hearth melt process of the present invention includes a specialized quadropole mass spectrometer which is used with other instruments to perform an analysis of the chemical components of the gas contained within the chamber in real time. Hydrogen is usually present in the 200 to 800 ppm range, being constantly evolved from the melting titanium. It is maintained at this level in the recycled gas stream by catalytic oxidation. Unusually high levels of hydrogen can indicate a furnace water leak since water is easily reduced by molten titanium. Oxygen is usually not detected unless a major air leak is present in the chamber because the molten titanium pool is a very effective oxygen getter. The kinetics of nitrogen dissolution in liquid titanium are apparently much slower. Therefore, the ability of the mass spectrometer to detect ppm levels of nitrogen makes it a useful air leak detector. The nitrogen, if undetected, will build up over time in the recycled gas stream until it is high enough to form titanium nitride defects in the ingot. Gas phase nitrating of liquid alloy is a known mechanism for the creation of hard alpha inclusions.

Short time casting rate measurement capability is useful to insure that liquid metal flow rates across the refining pool or pools are being properly maintained. Refining mechanisms such as density separation and dissolution of particles are both enhanced when the flow conditions are uniform. The preferred embodiment of the present invention includes a short time casting rate monitor that has the capability to measure the position of the top of the liquid in the ingot mold. This is accomplished by imaging the inside surface of the mold where the liquid alloy touches the surface of the mold. With an established reference, the ingot length can be continuously monitored and fed into a computer which calculates the ingot volume. This data is taken about every few seconds, providing the ability to monitor the liquid flow from the refining hearth over a very short period of time.

Further details of a plasma cold hearth melting furnace suitable for use in the present invention are given in two accompanying papers by W. R. Chinnis, identified as:

(1) "Plasma Cold Hearth Melting of Titanium in a Production Furnace"; and (2) "Advances in Titanium Cold Hearth Melting."

The second paper listed above also appears in the collection of papers entitled *Titanium* '95: *Science and Technology.* These two papers are incorporated by reference as part of this application. Examples of other cold hearth furnaces that could be used in the present invention are described in U.S. Reissue Pat. No. 32,932, reissued May 30, 1989, and in U.S. Pat. No. 4,861,001 granted on Aug. 29, 1989, and which are incorporated herein by reference. Further characteristic features of the improved ingot obtained in the present invention and further aspects of the process of the present invention are described in the previously noted Shamblen and Chinnis papers which have been incorporated herein by reference and in the accompanying paper by W. H. Buttrill and C. E. Shamblen, entitled "Hearth Melt Plus Vacuum Arc Remelt: Production Status", which appeared in a collection of papers entitled *Titanium* '95: *Science and Technology.* This paper is incorporated herein by reference.

In accordance with a further aspect of the present invention, there is provided an improved titanium ingot. The ingot of the present invention is produced by plasma cold hearth melting under subatmospheric conditions. The ingot of the present invention is characterized by having a fine ingot structure with minimal solidification segregation and improved low cycle fatigue properties. The ingot is further characterized by the substantial absence of inert gas filled voids (helium bubbles) and by having a smooth surface without ingot sidewall cold-shuts which cause loss in yield in conversion from ingot to billet.

The present invention is applicable to titanium and to alloys of titanium, including titanium based super alloys. The present invention is especially suited for producing high quality alloys of various titanium alloy compositions known for use in the aerospace and aircraft industry and in biomedical applications, including but not limited to the following: Ti-6-4; Ti-6246; Ti-17; Ti-6242; Alloy C; Ti-8-1-1; Titanium Aluminides; Ti-15 Mo; TMZF; Beta 21S; Ti-10-2-3; as well as commercially pure (CP) titanium.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of producing a titanium ingot consisting of:

supplying raw materials for a desired titanium composition to a plasma cold hearth furnace having a melting hearth and at least one refining hearth;

melting the raw materials for the composition on the cold hearth furnace with at least one plasma torch which utilizes an inert gas;

maintaining the composition in a molten state in the cold hearth furnace under a subatmospheric inert gas atmosphere to refine the composition; and forming the thus refined titanium composition into an ingot.

2. The method according to claim 1, wherein said step of maintaining the composition under a subatmospheric inert gas pressure comprises maintaining the pressure in the cold hearth furnace below 500 torr.

3. The method according to claim 2, wherein the subatmospheric inert gas pressure is maintained at between 280 and 400 torr.

4. The method according to claim 1, wherein said step of forming the titanium composition into an ingot comprises casting the molten titanium composition into an ingot mold, allowing the composition to cool and solidify in the ingot mold, and removing the titanium ingot from the ingot mold.

5. The method according to claim 4, including the further step of subjecting the thus formed ingot to hot working and fabrication operations without any intervening melting or refining steps.

6. A method of producing a titanium ingot consisting of:

supplying raw materials for a desired titanium composition to a plasma cold hearth furnace having a melting hearth and at least one refining hearth;

melting the raw materials for the titanium composition on the melting hearth of the cold hearth furnace with at least one plasma torch which utilizes an inert gas;

directing the molten composition to said at least one refining hearth while maintaining the composition in a molten state on the refining hearth under a subatmospheric inert gas atmosphere to allow impurities present in the composition to be refined therefrom;

pouring the molten composition from the cold hearth furnace into an ingot mold while still under said subatmospheric inert gas atmosphere;

allowing the composition to cool and solidify in the ingot mold; and removing the thus formed titanium ingot from the ingot mold.

7. The method according to claim 6, including the further step of subjecting the thus formed ingot to hot working and fabrication operations without any intervening melting or refining steps.

8. A method of producing a titanium ingot comprising:

supplying raw materials for a desired titanium composition to a plasma cold hearth furnace having a melting hearth and at least one refining hearth;

melting the raw materials for the titanium composition on the melting hearth of the cold hearth furnace with at least one plasma torch which utilizes an inert gas;

directing the molten composition to said at least one refining hearth while maintaining the composition in a molten state on the refining hearth under a subatmospheric inert gas atmosphere to allow impurities present in the composition to be refined therefrom;

pouring the molten composition from the cold hearth furnace into an ingot mold while still under said subatmospheric inert gas atmosphere;

allowing the composition to cool and solidify in the ingot mold;

removing the thus formed titanium ingot from the ingot mold; and subjecting the ingot, thus removed from the ingot mold, to hot working and fabrication operations without any intervening melting or refining steps.

* * * * *